US007229728B2

(12) United States Patent
Lee et al.

(10) Patent No.: US 7,229,728 B2
(45) Date of Patent: Jun. 12, 2007

(54) POSITIVELY-CHARGED ELECTROPHOTOGRAPHIC ORGANIC PHOTORECEPTOR

(75) Inventors: Nam-jeong Lee, Gyeonggi-do (KR); Hae-ree Joo, Seoul (KR); Kyong-yol Yon, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 209 days.

(21) Appl. No.: 10/716,452

(22) Filed: Nov. 20, 2003

(65) Prior Publication Data

US 2004/0137346 A1 Jul. 15, 2004

(30) Foreign Application Priority Data

Jan. 10, 2003 (KR) ..... 10-2003-0001604

(51) Int. Cl.
*G03G 5/047* (2006.01)

(52) U.S. Cl. ..... 430/59.1; 430/59.4; 430/66; 430/133; 399/159

(58) Field of Classification Search ..... 430/59.4, 430/59.1, 66, 133; 399/159, 116
See application file for complete search history.

(56) References Cited

U.S. PATENT DOCUMENTS

| | | | | |
|---|---|---|---|---|
| 5,153,085 | A * | 10/1992 | Akasaki et al. | 430/58.25 |
| 6,656,650 | B1 * | 12/2003 | Lin et al. | 430/56 |

FOREIGN PATENT DOCUMENTS

| | | | |
|---|---|---|---|
| JP | 02-097961 | | 4/1990 |
| JP | 06-123987 | | 5/1994 |
| JP | 9-319128 | * | 9/1997 |
| JP | 10-020536 | | 1/1998 |
| JP | 2000-122327 | | 4/2000 |

OTHER PUBLICATIONS

Patent Abstract of Japan 02-097961 Oct. 4, 1990.*
Japanese Patent Office Action for corresponding Japanese Patent Application No. 2004-005975 dated Oct. 14, 2005.

* cited by examiner

*Primary Examiner*—John L Goodrow
(74) *Attorney, Agent, or Firm*—Staas & Halsey LLP

(57) ABSTRACT

A positively-charged electrophotographic organic photoreceptor includes an electrically conductive support, and a charge transport layer and a charge generating layer sequentially stacked on the electrically conductive support. The charge generating layer is formed by coating a charge generating layer forming composition that includes a fluorene compound, a charge generating material, a binder resin and an organic solvent on the charge transport layer, and drying. The organic photoreceptor has high sensitivity, while suppressing contamination of a charge generating layer during coating, and thicknesses of a charge transport layer and a charge generating layer may be adjusted. Also, the electrostatic properties of the organic photoreceptor, including charge potential and exposure potential, may be easily adjusted. The organic photoreceptor may be applied to an electrophotographic development system using a liquid toner having a small particle size and a high retained charge amount with an increased surface charge amount of the organic photoreceptor.

32 Claims, 1 Drawing Sheet

POSITIVELY-CHARGED ELECTROPHOTOGRAPHIC ORGANIC PHOTORECEPTOR

CROSS-REFERENCE TO RELATED APPLICATIONS

This application claims priority from Korean Patent Application No. 2003-1604, filed on Jan. 10, 2003, in the Korean Intellectual Property Office, the disclosure of which is incorporated herein in its entirety by reference.

BACKGROUND OF THE INVENTION

1. Field of the Invention

The present invention relates to a positively-charged electrophotographic organic photoreceptor, and more particularly, to a multi-layered positively-charged organic photoreceptor having improved sensitivity and electrostatic properties.

2. Description of the Related Art

Double-layered positively-charged electrophotographic organic photoreceptors basically include an electrically conductive support, a charge transport layer, and a charge generating layer.

Since the charge generating layer is thin, it may be easily worn due to friction between the charge generating layer and toner, and friction between the charge generating layer and a cleaning blade. To overcome this problem, an overcoat layer may be further formed on the charge generating layer. Also, an adhesive layer for improving adhesiveness between the electrically conductive support and the charge transport layer, or a charge blocking layer for preventing migration of charges, may be further formed between the electrically conductive support and the charge transport layer.

An electrophotographic imaging process using such a double-layered positively-charged organic photoreceptor is as follows.

After positively charging the surface of an organic photoreceptor, a laser beam is used to irradiate a charge generating layer to generate positive and negative charges. Positive charges (holes) are injected into a charge transport layer by applied electric field to the organic photoreceptor and migrate to an electrically conductive support. The negative charges (electrons) migrate to the surface of the organic photoreceptor to neutralize the surface charges. A surface potential varies by exposure, so that a latent image is formed in an exposed region. Then, this latent image is developed with toner, thus forming an image on the surface of the photoreceptor. The thus-formed image is transferred on the surface of a receptor, such as paper or a transfer belt.

Compared with single-layered organic photoreceptors requiring complex electrical properties for a single layer, double-layered positively-charged organic photoreceptors including two layers responsible for different functions may more easily control electrical properties, such as charge potential and exposure potential.

Also, since a stable electric field may be applied to the thin surface layers of double-layered positively-charged organic photoreceptor, the photoreceptor may retain a larger amount of charge at a given field strength and develop images with a larger amount of toner. Thus, such a double-layered positively-charged organic photoreceptor may be advantageously used for development of a liquid toner having a small particle size and a large charge amount.

However, when a composition to form the charge generating layer of the double-layered positively-charged organic photoreceptor is coated on the charge transport layer, the charge transport layer is partially dissolved in an organic solvent contained in the composition, resulting in a change in the thickness of the charge transport layer or elution of components of the charge transport layer. The change in the thickness of the charge transport layer reduces the charge potential of the organic photoreceptor.

To resolve these problems, use of a solvent incapable of dissolving components of a charge transport layer as an organic solvent of the composition for forming a charge generating layer has been suggested.

However, the thus manufactured double-layered organic photoreceptor has a definitely defined interface between a charge transport layer and a charge generating layer, so that charges generated at the charge generating layer by a laser beam may not be injected into the charge transport layer. Thus, a surface potential of an exposed portion is not sufficiently reduced. In addition, an exposure potential may continuously increase with repeated use.

Japanese Patent Laid-open publication No. hei 2-97961 discloses a negatively-charged electrophotographic photoreceptor having a charge generating layer and a charge transport layer sequentially stacked on an electrically conductive support, wherein the charge generating layer comprises a charge generating pigment having a hole transporting function and a fluorene compound in a binder resin.

However, the conventional organic photoreceptor is still open to improvement because it is not satisfactory in view of the sensitivity with increased printing speed and the exposure potential and the residual potential with repeated electrophotographic processes.

SUMMARY OF THE INVENTION

The present invention provides a positively-charged organic photoreceptor having an increased sensitivity and electrostatic properties.

The present invention also provides an electrophotographic imaging method using the above positively-charged organic photoreceptor, by which the sensitivity of the organic photoreceptor is increased with increased printing speed, and increases in exposure potential and residual potential are effectively suppressed under repeated electrophotographic processes.

In accordance with an aspect of the present invention, a positively-charged electrophotographic organic photoreceptor comprises: an electrically conductive support; and a charge transport layer and a charge generating layer sequentially stacked on the electrically conductive support, wherein the charge generating layer is formed by coating a charge generating layer forming composition comprising a 9-fluorenone compound represented by Formula 1, a charge generating material, a binder resin and an organic solvent, and drying: Formula 1

Formula 1

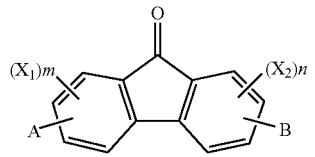

wherein A and B are independently selected from the group consisting of a carboxyl group (-COOH), a substituted or unsubstituted $C_2$-$C_{10}$ alkoxycarbonyl group and a substituted or unsubstituted $C_2$-$C_{10}$ alkylaminocarbonyl group, $X_1$ and $X_2$ are independently a halogen atom, and m and n are independently an integer from 0 to 3.

In accordance with another aspect of the present invention, the organic photoreceptor directly contacts the liquid toner in an electrophotographic imaging process.

Examples of apparatuses in which the positively-charged electrophotographic organic photoreceptor of the present invention may be included are an electrophotographic cartridge, an electrophotographic drum and/or an image forming apparatus.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
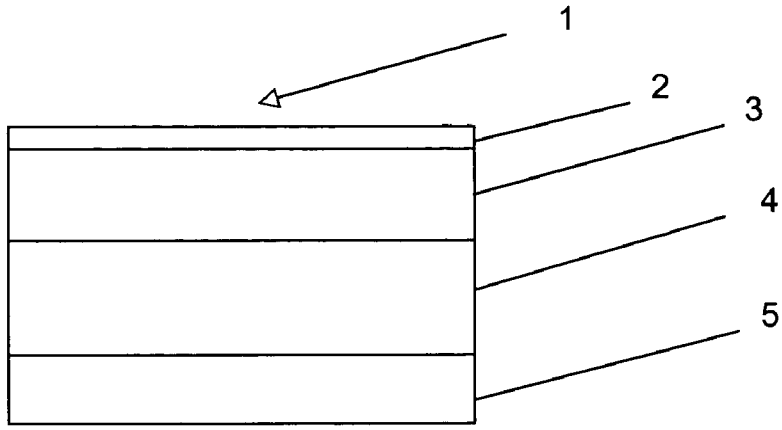
FIG. 1 is a block diagram illustrating (not to scale) a positively-charged electrophotographic organic photoreceptor comprising an electrically conductive support, and a charge transport layer and a charge generating layer sequentially stacked on the electrically conductive support, with an optional overcoat layer, in accordance with an embodiment of the present invention.

Reference will now be made in detail to embodiments of the present invention, examples of which are illustrated in the accompanying drawings, wherein like reference numerals refer to the like elements throughout. The embodiments are described below to explain the present invention by referring to the figures.

Although a few embodiments of the present invention have been shown and described, it would be appreciated by those skilled in the art that changes may be made in this embodiment without departing from the principles and spirit of the invention, the scope of which is defined in the claims and their equivalents.

A positively-charged organic photoreceptor according to an embodiment of the present invention may include a charge transport layer and a charge generating layer sequentially stacked on an electrically conductive support.

A composition to form the charge generating layer has a 9-fluorenone compound represented by Formula 1 as an electron transport material and charges generated by a laser beam are easily injected into a charge transport layer and an overcoat layer:

Formula 1

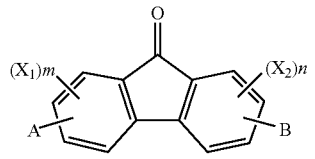

wherein A and B are independently selected from the group consisting of a carboxyl group (—COOH), a substituted or unsubstituted $C_2$-$C_{10}$ alkoxycarbonyl group and a substituted or unsubstituted $C_2$-$C_{10}$ alkylaminocarbonyl group, $X_1$ and $X_2$ are independently a halogen atom, and m and n are independently an integer from 0 to 3.

The composition to form the charge generating layer according to an embodiment of the present invention includes a charge generating material, a binder, a 9-fluorenone compound represented by Formula 1 as an electron transport material, and a solvent. The amount of the 9-fluorenone compound is typically in a range of 0.1-20 parts by weight based on 100 parts by weight of the total weight of the solid content of the composition. If the amount of the 9-fluorenone compound is not in the range specified above, negative charges may not be effectively injected, resulting in an increase in exposure potential or sudden drop of a charge potential with repeated electrophotographic processes. The solid refers to a material remaining as a component of an organic photoreceptor without being evaporated even after drying. In the present invention, the solid content refers to a mixture of a charge generating material, a 9-fluorenone compound represented by Formula 1 and a binder.

An example of a workable compound includes 9-oxo-9-fluorenone-4-carboxylic acid represented by Formula 2:

Formula 2

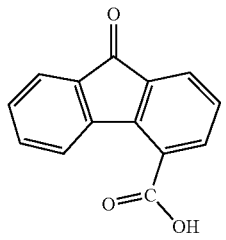

The charge generating material used in the charge generating layer forming composition is a material that generates charge carriers by absorbing light. Examples thereof include a metal-free phthalocyanine (e.g., Progen 1x-form metal-free phthalocyanine, ZENECA, INC.), and a metal phthalocyanine, such as titanium phthalocyanine, copper phthalocyanine, oxytitanium phthalocyanine, or hydroxygallium phthalocyanine. The charge generating material is typically used in an amount of 55 to 85 parts by weight. If the amount of the charge generating material is outside of the range specified above, charge generating capability is undesirably poor.

The binder for the charge generating layer forming composition dissolves or disperses the charge generating material, and examples thereof include polyvinyl butyral, polycarbonate, poly(styrene-co-butadiene), modified acryl polymer, polyvinyl acetate, styrene-alkyd resin, soya-alkyl resin, polyvinyl chloride, polyvinylidene chloride, polyacrylonitrile, polyacrylic acid, polyacrylate, polymethacrylate, styrene polymer, alkyd resin, polyamide, polyurethane, polyester, polysulfone, polyether and mixtures thereof. The binder is generally used in an amount of 10 to 40 parts by weight, based on 100 parts by weight of the total weight of the solid content of the charge generating layer forming composition. If the amount of the binder is less than 10 parts by weight, the bonding strength between the charge transport layer and the charge generating layer is lowered. If the amount of the binder is greater than 40 parts by weight, since the amount of the charge generating material in the charge generating layer is relatively lowered, the charge generating capability is undesirably reduced.

The organic solvent for use in the charge generating layer forming composition may include alcoholic solvents and acetate-based solvents. Examples of the alcoholic solvents include ethanol, isopropyl alcohol, n-butanol, methanol, 1-methoxy-2-propanol, diacetone alcohol, isobutyl alcohol, t-butyl alcohol and a mixture thereof. Examples of the acetate-based solvents include ethyl acetate, butyl acetate, isopropyl acetate, isobutyl acetate, sec-butyl acetate and a mixture thereof. The amount of the acetate-based solvent is typically in a range of 10 to 50 parts by weight based on 100 parts by weight of the total weight of the organic solvent. In the charge generating layer forming composition, the content ratio of the solid content to the organic solvent (which is a mixture of an alcoholic solvent and an acetate-based solvent) is approximately 1:99 to 10:90. If the content ratio is higher than 10:90, the charge generating layer becomes thick, deteriorating the electrophotographic properties, including an increase in dark decay. If the total amount of the alcoholic solvent and the acetate-based solvent content ratio is lower than approximately 1:99, the charge generating layer is too thin to be effective. Thus, when a laser beam irradiates the thin coating, the absolute value of the charge amount is small, so that the exposure potential of the irradiated portion may be high. If the content ratio of the alcoholic solvent to the acetate-based organic solvent falls short of the range specified above, components of the charge transport layer are dissolved when coated on the charge transport layer, making the coating impossible. If the content ratio of the alcoholic solvent to the acetate-based organic solvent exceeds the range specified above, an interface between the charge transport layer and the charge generating layer is not properly formed, making charge injection difficult, so that exposure potential may increase.

The charge generating layer forming composition may further include a basic compound. Addition of such a basic compound advantageously increases the solubility of an added electron transport material. Examples of the basic compound include ammonium hydroxide and sodium hydroxide. The amount of the basic compound is preferably in a range of 1 to 20 parts by weight, based on 100 parts by weight of the total weight of the solid content of the charge generating layer forming composition.

The charge transport layer forming composition includes a first hole transport material, a second hole transport material, a binder and a solvent.

As the first hole transport material, at least one selected from the stilbene-series charge transport materials represented by Formula 3 is used:

Formula 3

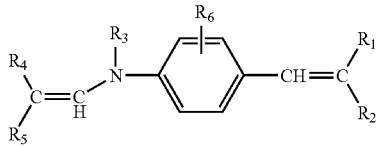

wherein $R_1$ and $R_2$ are independently a hydrogen atom, a substituted or unsubstituted $C_1$-$C_{20}$ alkyl group, a substituted or unsubstituted $C_6$-$C_{20}$ aryl group or a substituted or unsubstituted styryl group, at least one of $R_1$ and $R_2$ is a substituted or unsubstituted $C_6$-$C_{20}$ aryl group or a substituted or unsubstituted styryl group; $R_3$ is a substituted or unsubstituted $C_1$-$C_{20}$ alkyl group, a substituted or unsubstituted $C_6$-$C_{20}$ aralkyl group, or a substituted or unsubstituted $C_6$-$C_{20}$ aryl group; $R_4$ and $R_5$ are independently a hydrogen atom, a substituted or unsubstituted $C_1$-$C_{20}$ alkyl group, a substituted or unsubstituted benzyl, or a substituted or unsubstituted $C_6$-$C_{20}$ aryl group; $R_6$ is a hydrogen atom, a substituted or unsubstituted $C_1$-$C_{20}$ alkyl group, a substituted or unsubstituted $C_1$-$C_{20}$ alkoxy group, or a halogen atom.

Examples of the stilbene-series charge transport materials represented by Formula 3 include compounds represented by Formula 4:

Formula 4

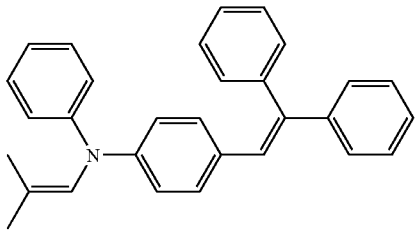

The second hole transport material is typically a charge transport material which is not easily dissolved in an acetate-based solvent, and examples thereof include at least one selected from the hydrazone-series charge transport materials represented by Formula 5:

Formula 5

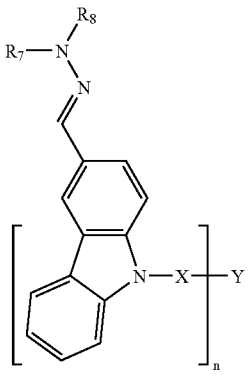

wherein n is an integer from 2 to 6, $R_7$ and $R_8$ are independently a $C_1$-$C_{20}$ alkyl group, a $C_5$-$C_{20}$ cycloalkyl group, or a $C_6$-$C_{20}$ aryl group, $R_7$ and $R_8$ is linked to a nitrogen atom to form a ring; Y is a bond, a carbon atom, a —$CR_9$ group, an $C_6$-$C_{20}$ aryl group, a $C_5$-$C_{20}$ cycloalkyl group, or a cyclosiloxyl group; $R_9$ is a hydrogen atom, a $C_1$-$C_{20}$ alkyl group, or a $C_6$-$C_{20}$ aryl group; X is a linking group having the formula —$(CH_2)_m$—, wherein m is an integer from 4 to 10 and at least one methylene group is substituted with a hydrogen atom, a carbonyl group or an ester group.

Examples of the hydrazone compound represented by Formula 5 include a compound represented by Formula 6:

Formula 6

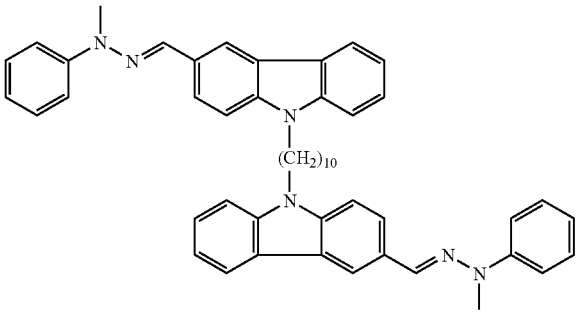

A total amount of the first hole transport material and the second hole transport material is preferably in a range of 40 to 60 parts by weight based on 100 parts by weight of the total weight of the solid content of the charge transport layer forming composition.

Examples of the binder used for the charge transport layer forming composition according to embodiments of the present invention include silicone resin, polyamide resin, polyurethane resin, polyester resin, epoxy resin, polyketone resin, polycarbonate resin, polycarbonate copolymer, polyestercarbonate resin, polyformal resin, poly(2,6-dimethylphenyleneoxide), polyvinylbutyral resin, polyvinylacetal resin, styrene-acryl copolymer, polyacryl resin, polystyrene resin, melamine resin, styrene-butadiene copolymer, polymethylmethacrylate resin, polyvinylchloride, ethylene-vinyl acetate copolymer, vinylchloride-vinylacetate copolymer, polyacrylamide resin, polyvinylcarbazole, polyvinylpyrazolin, polyvinylpyrene and polyester copolymer. These binders may be used alone or in a mixed form. The amount of the binder ranges from 40 to 60 parts by weight based on 100 parts by weight of the total weight of solid content of the charge transport layer forming composition. If the amount of the binder is less than 40 parts by weight, the film formability of the charge transport material may deteriorate, and the charge transport material may be easily dissolved during the coating of the charge generating layer forming composition. If the amount of the binder is greater than 60 parts by weight, a relative amount of the charge transport material is reduced, lowering the moving capability of the injected charges.

Examples of the organic solvent used for the charge transport layer forming composition include aromatic solvents, e.g., toluene, xylene or anisole; ketone solvents, e.g., cyclohexanone or methylcyclohexanone; halogenated hydrocarbon solvents, e.g., methylene chloride or tetrachlorocarbon; and ether solvents, e.g., tetrahydrofuran, 1,3-dioxolane or 1,4-dioxane. These solvents may be used alone or in a mixture form. The amount of the organic solvent is in a range of approximately 70 to 80% by weight based on the total weight of the charge transport layer forming composition and the solid content ranges from 20 to 30% by weight. If the amount of the organic solvent is less than 70% by weight, the charge transport material and the binder are not dissolved, so that a stable coating composition may not be obtained. If the amount of the organic solvent is greater than 80% by weight, the viscosity of the coating composition is too low to obtain a charge transport layer having a desired thickness.

If necessary, the charge transport layer forming composition and charge generating layer forming composition according to an embodiment of the present invention may further include an additive such as a plasticizer, a flowability control agent, an anti-pinhole agent, an antioxidant or a UV absorbent. A total amount of the additive is in a range of 0.001 to 5 parts by weight based on 100 parts by weight of the total weight of the charge generating material or the charge transport material.

Examples of the plasticizer include biphenyl, 3,3',4,4'-tetramethyl-1,1'-phenyl, 3,3",4,4"-tetramethyl-p-terphenyl, 3,3",4,4"-tetramethyl-m-terphenyl, paraffin halide, dimethylnaphthalene and dibutylphthalate. Examples of the flowability control agent include Modaflow (manufactured by MONSANTO CHEMICAL CO.) and Acronal 4 F (manufactured by BASF).

Examples of the anti-pinhole agent include benzoin and dimethylphthalate. Examples of the antioxidant and the UV absorbent include 2,6-di-t-butyl-4-methylphenol, 2,4-bis(n-octylthio)-6-(4-hydroxy-3,5-di-t-butylanilino)-1,3,5-triazine, 1,3,5-trimethyl-2,4,6-tris(3,5-di-t-butyl-4-hydroxybenzyl) benzene, 2-(5-t-butyl-2-hydroxyphenyl) benzotriazole, and 2-[2-hydroxy-3,5-bis(α,α-dimethylbenzyl)phenyl]-2H-benzotriazole.

A method of preparing a double-layered positively-charged electrophotographic organic photoreceptor according to an embodiment of the present invention will now be described.

The charge transport layer forming composition is coated on an electrically conductive support and dried to form a charge transport layer. Examples of the coating method of the charge transport layer forming composition include, but are not limited to, ring coating, dip coating and spray coating. The drying is generally performed at a temperature ranging from 80 to 140° C. for 5 to 90 minutes, giving a charge transport layer having a thickness of approximately 5 to 20 μm.

Next, a charge generating layer coating composition comprising a charge generating material, a binder, an alcohol solvent and an acetate-based solvent is coated on the charge transport layer and dried to form a charge generating layer.

Examples of the coating method of the charge generating layer forming composition include, but are not limited to, ring coating, dip coating and spray coating. The drying is generally performed at a temperature ranging from 80 to 140° C. for 5 to 90 minutes, giving a charge generating layer having a thickness of approximately 0.2 to 1.0 μm.

Also, the double-layered positively-charged electrophotographic organic photoreceptor according to an embodiment of the present invention may further include an overcoat layer formed on the charge generating layer and an adhesive layer formed between the charge transport layer and the electrically conductive layer. Since the charge generating layer is too thin, it is easily worn by friction from toner and a cleaning blade. To overcome this problem, the overcoat layer may be further formed on the charge generating layer. To enhance adhesiveness between the electrically conductive layer and the charge transport layer and to prevent movement of charges, the adhesive layer may be further formed between the electrically conductive layer and the charge transport layer. Examples of materials for the overcoat layer include, but are not limited to, polyaminoether, polyurethane, and silsesquioxanes.

The double-layered positively-charged organic photoreceptor according to an embodiment of the present invention has an interface appropriately formed between the charge generating layer and the charge transport layer. Thus, charges generated at the charge generating layer may be easily injected into the charge transport layer. Accordingly, the organic photoreceptor according to an embodiment of the present invention may be advantageously used for an electrophotographic imaging process using dry or liquid toner, in particular liquid toner. In the case of using a liquid toner, an image having high resolution while requiring low energy in fixing the image may be obtained.

An electrophotographic imaging process using the organic photoreceptor according to an embodiment of the present invention will now be described.

First, the surface of the organic photoreceptor according to an embodiment of the present invention is uniformly charged and subjected to imagewise exposure to form an electrostatic latent image thereon. Next, liquid developer (toner) is directly applied to the surface of the organic photoreceptor having the electrostatic latent image to form a toned image. Next, the toned image is transferred to a receptor, such as intermediate transfer belt or paper, thus forming an image.

The present invention will be described in greater detail with reference to the following examples. The following examples are for illustrative purposes and are not intended to limit the scope of the invention.

EXAMPLE 1

1.15 g of a compound represented by Formula 4 as a first hole transport material, 1.15 g of a compound represented by Formula 6 as a second hole transport material, 0.23 g of polyethyleneterephthalate (O-PEt, KANEBO, Japan) and 2.07 g of polycarbonate (PCZ200, MITSUBISHI CHEMICAL, Japan) were dissolved in 15.4 g of tetrahydrofuran to prepare a charge transport layer forming composition. The thus prepared composition was filtered through a syringe filter having an average pore size of 1 μm and coated on an aluminum drum using a ring coater at a coating speed of 300 mm/min, followed by drying at 110° C. for 15 minutes, thereby preparing a charge transport layer having a thickness of approximately 8 μm.

Separately, 0.84 g of polyvinylbutyral (BX-1, available from Sekisui Co., Japan) was dissolved in 17.2 g of ethanol and mixed with 1.96 g of titanyloxy phthalocyanine (TiOPc) as a charge generating material. The resulting mixture was milled in an attrition-type miller for 1 hour, thereby obtaining a dispersion.

0.04 g of a compound represented by Formula 2 was dissolved in 7.68 g of butyl acetate. In this solution, 5.11 g of the above dispersion was mixed with 7.21 g of ethanol to prepare a charge generating layer forming composition. The thus prepared composition was filtered through a syringe filter having an average pore size of 5 μm and coated on an aluminum drum using a ring coater at a coating speed of 250 mm/min, followed by drying at 110° C. for 15 minutes, thus preparing a charge generating layer having a thickness of approximately 0.3 μm.

11.70 g of distilled water and 1.90 g of isopropyl alcohol were mixed, and 2.50 g of anionic aqueous polyurethane dispersion (HWU 305A having a solid content of 40%, 55% water and 5% NMP, manufactured by HEPCE CHEM CO., LTD., Korea) was added thereto and mixed, followed by subjecting to ultrasonic treatment for 1 hour, thus obtaining an overcoat layer coating composition. The thus obtained coating composition was filtered through a syringe filter having an average pore size of 5 μm and coated on the charge generating layer using a ring coater at a coating speed of 200 mm/min, followed by drying at an oven at 120° C. for 20 minutes, thus preparing an overcoat layer and completing an organic photoreceptor.

EXAMPLE 2

An organic photoreceptor was manufactured in the same manner as in Example 1, except that in forming a charge generating layer forming composition, 0.08 g of a compound represented by Formula 2 was used instead of 0.04 g.

EXAMPLE 3

An organic photoreceptor was manufactured in the same manner as in Example 1, except that in forming a charge generating layer forming composition, 0.16 g of a compound represented by Formula 2 was used instead of 0.04 g.

Comparative Example 1

An organic photoreceptor was manufactured in the same manner as in Example 1, except that in forming a charge generating layer forming composition, a compound represented by Formula 2 was not used.

The charge potential and the exposure potential of each of the organic photoreceptors prepared in Examples 1-3 and Comparative Example 1 were measured, and the measurement results are shown in Table 1. The charge potential ($V_o$) and the exposure potential ($V_d$) were measured using an electrophotographic cycling (charge-exposure-erase) apparatus, a linear speed of a drum was 5 inch/sec, and a laser power was 0.3 mW.

TABLE 1

| | Example 1 | Example 2 | Example 3 | Comparative Example 1 |
|---|---|---|---|---|
| $V_o$ (V) {1 cycle} | 795 | 790 | 785 | 800 |
| $V_d$ (V) {1 cycle} | 70 | 60 | 50 | 80 |
| $V_o$ (V) {3000 cycles} | 810 | 800 | 795 | 815 |
| $V_d$ (V) {3000 cycles} | 100 | 85 | 75 | 120 |

As shown in Table 1, unlike in Comparative Example 1, in which the compound represented by Formula 2 was not used for the charge generating layer forming composition, in Examples 1-3, in which the compound represented by Formula 2 was used for the charge generating layer forming composition, the organic photoreceptors had low exposure potential and showed a reduced increase in exposure potential with a repetition of 3000 charge-exposure-erase cycles.

According to embodiments of the present invention, an organic photoreceptor having high sensitivity while suppressing contamination of a charge generating layer during coating may be obtained, and thicknesses of a charge transport layer and a charge generating layer may be adjusted. Also, electrostatic properties of the organic photoreceptor according to embodiments of the present invention, including the charge potential and the exposure potential, may be easily adjusted. Since the photoreceptor has a high charge potential and a low exposure potential even if a thin charge generating layer is formed, embodiments of the present invention may be applied to an electrophotographic development system using a liquid toner having a small particle size and a high retained charge amount with an increased surface charge amount of the organic photoreceptor.

FIG. 1 is a block diagram illustrating (not to scale) a positively-charged electrophotographic organic photoreceptor 1 comprising an electrically conductive support 5, and a charge transport layer 4 and a charge generating layer 3 sequentially stacked on the electrically conductive support 5, with an optional overcoat layer 2, in accordance with an embodiment of the present invention.

Figure 2:
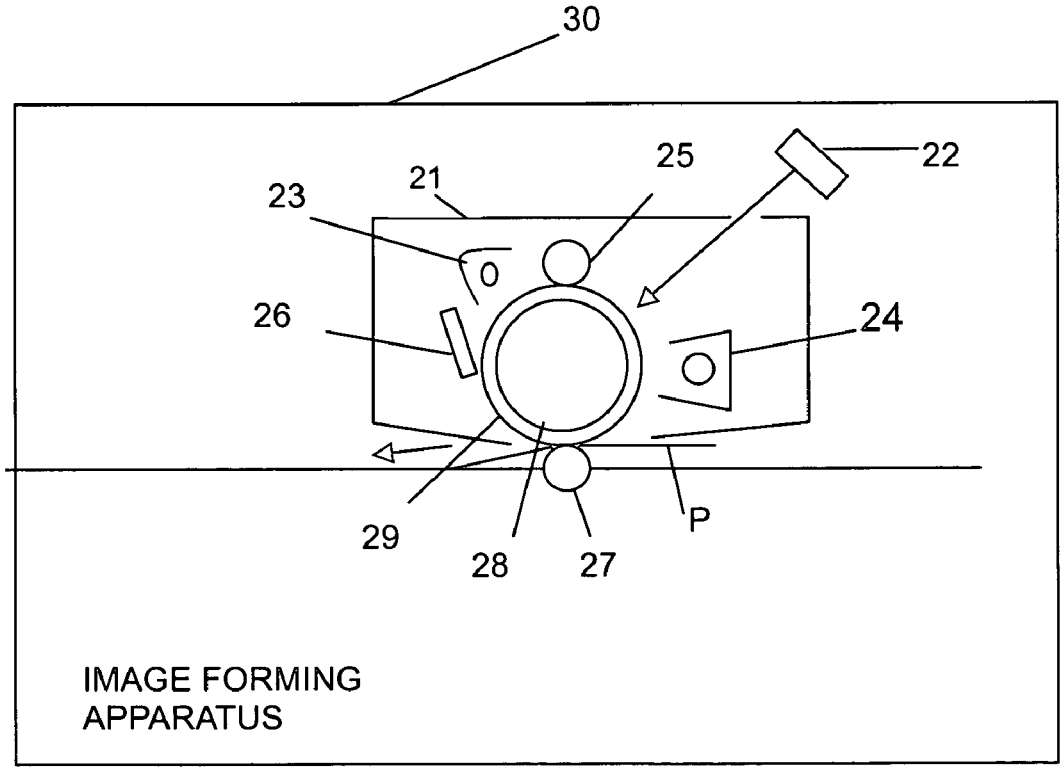
FIG. 2 is a schematic representation of an image forming apparatus, an electrophotgraphic drum, and an electrophographic cartridge in accordance with selected embodiments of the present invention.

FIG. 2 is a schematic representation of an image forming apparatus 30, an electrophotographic drum 28, and an electrophotographic cartridge 21 in accordance with selected embodiments of the present invention. The electrophotographic cartridge 21 typically comprises an electrophotographic photoreceptor 29 and at least one of a charging device 25 that charges the electrophotographic photoreceptor 29, a developing device 24 which develops an electrostatic latent image formed on the electrophotographic photoreceptor 29, and a cleaning device 26 which cleans a surface of the electrophotographic photoreceptor 29. The electrophotographic cartridge 21 may be attached to or detached from the image forming apparatus 30, and the electrophotographic photoreceptor 29 is described more fully above.

The electrophotographic photoreceptor drum 28, 29 for an image forming apparatus 30, generally includes a drum 28 that is attachable to and detachable from the electrophotographic apparatus 30 and that includes an electrophotographic photoreceptor 29 disposed on the drum 28, wherein the electrophotographic photoreceptor 29 is described more fully above.

Generally, the image forming apparatus 30 includes a photoreceptor unit (e.g., an electrophotographic photoreceptor drum 28, an electrophotographic photoreceptor 29), a charging device 25 which charges the photoreceptor unit, an imagewise light irradiating device 22 which irradiates the charged photoreceptor unit with imagewise light to form an electrostatic latent image on the photoreceptor unit, a developing unit 24 that develops the electrostatic latent image with a toner to form a toner image on the photoreceptor unit, and a transfer device 27 which transfers the toner image onto a receiving material, such as paper P, wherein the photoreceptor unit comprises an electrophotographic photoreceptor 29 as described in greater detail above. The charging device 25 may be supplied with a voltage as a charging unit and may contact and charge the electrophotographic receptor. Where desired, the apparatus may include a pre-exposure unit 23 to erase residual charge on the surface of the electrophotographic photoreceptor 29 to prepare for a next cycle.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A positively-charged electrophotographic organic photoreceptor comprising:

an electrically conductive support; and a charge transport layer and a charge generating layer sequentially stacked on the electrically conductive support, wherein the charge generating layer is formed by coating a charge generating layer forming composition comprising a 9-fluorenone compound represented by Formula 1, a charge generating material, a binder resin and an organic solvent on the charge transport layer, and drying:

Formula 1

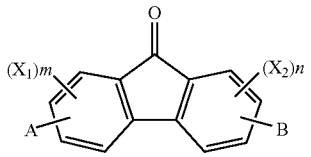

wherein A is selected from the group consisting of a carboxyl group, a substituted or unsubstituted $C_2$-$C_{10}$ alkoxycarbonyl group and a substituted or unsubstituted $C_2$-$C_{10}$ alkylaminocarbonyl group, B is a carboxyl group, $X_1$ and $X_2$ are independently a halogen atom, and m and n are independently an integer from 0 to 3.

2. A positively-charged electrophotographic organic photoreceptor comprising:

an electrically conductive support; and a charge transport layer and a charge generating layer sequentially stacked on the electrically conductive support, wherein the charge generating layer is formed by coating a charge generating layer forming composition comprising a 9-fluorenone compound, a charge generating material, a binder resin and an organic solvent on the charge transport layer, and drying:

wherein the 9-fluorenone compound is represented by Formula 2:

Formula 2

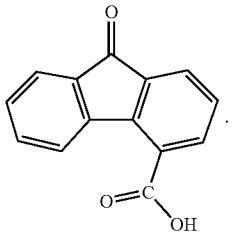

3. The positively-charged electrophotographic organic photoreceptor of claim 1, wherein an amount of the 9-fluorenone compound represented by Formula 1 is in a range of 0.1-20 parts by weight based on 100 parts by weight of a total weight of a solid content of the charge generating layer forming composition.

4. The positively-charged electrophotographic organic photoreceptor of claim 1, wherein the organic solvent is a mixed solvent of an alcoholic solvent and an acetate-based solvent.

5. The positively-charged electrophotographic organic photoreceptor of claim 4, wherein an amount of the acetate-based solvent is in a range of 10 to 50 parts by weight based on a total weight of the organic solvent.

6. The positively-charged electrophotographic organic photoreceptor of claim 4, wherein the alcoholic solvent is at least one selected from the group consisting of ethanol isopropyl alcohol, n-butanol, methanol, 1-methoxy-2-propanol, diacetone alcohol, isobutyl alcohol and t-butyl alcohol, and the acetate-based solvent is at least one selected from the group consisting of ethyl acetate, butyl acetate, isopropyl acetate, isobutyl acetate and sec-butyl acetate.

7. The positively-charged electrophotographic organic photoreceptor of claim 1, wherein the charge generating layer forming composition further comprises a basic compound.

8. The positively-charged electrophotographic organic photoreceptor of claim 7, wherein the basic compound is at least one selected from the group consisting of ammonium hydroxide and sodium hydroxide, and an amount of the basic compound is in a range of 1 to 20 parts by weight based on 100 parts by weight of a total weight of solid content of the charge generating layer forming composition.

9. The positively-charged electrophotographic organic photoreceptor of claim 1, wherein an overcoat layer is further formed on the charge generating layer.

10. The positively-charged electrophotographic organic photoreceptor of claim 9, wherein the overcoat layer includes at least one selected from the group consisting of polyaminoether, polyurethane and silsesquioxanes.

11. The positively-charged electrophotographic organic photoreceptor of claim 1, wherein the charge generating material is a phthalocyanine pigment, and an amount of the charge generating material is in a range of 55 to 85 parts by weight based on 100 parts by weight of a total weight of a solid content of the charge generating layer forming composition.

12. The positively-charged electrophotographic organic photoreceptor of claim 1, wherein the binder is polyvinylbutyral, and an amount of the binder is in a range of 10 to 40 parts by weight based on a total weight of a solid content of the charge generating layer forming composition.

13. An electrophotographic cartridge, comprising:

a positively-charged electrophotographic organic photoreceptor comprising:

an electrically conductive support; and a charge transport layer and a charge generating layer sequentially stacked on the electrically conductive support, wherein the charge generating layer is formed by coating a charge generating layer forming composition comprising a 9-fluorenone compound represented by Formula 1, a charge generating material, a binder resin and an organic solvent on the charge transport layer, and drying:

Formula 1

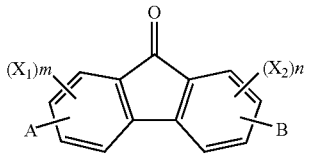

wherein A is selected from the group consisting of a carboxyl group, a substituted or unsubstituted $C_2$-$C_{10}$ alkoxycarbonyl group and a substituted or unsubstituted $C_2$-$C_{10}$ alkylaminocarbonyl group, B is a carboxyl group, $X_1$ and $X_2$ are independently a halogen atom, and m and n are independently an integer from 0 to 3; and at least one of:

a charging device that charges the electrophotographic photoreceptor;

a developing device which develops an electrostatic latent image formed on the electrophotographic photoreceptor; and a cleaning device which cleans a surface of the electrophotographic photoreceptor, wherein the electrophotographic cartridge is attachable to/detachable from an image forming apparatus.

14. The electrophotographic cartridge of claim 13, wherein the 9-fluorenone compound represented by Formula 1 includes a compound represented by Formula 2:

Formula 2

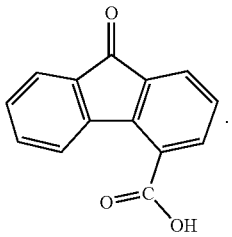

15. The electrophotographic cartridge of claim 13, wherein an amount of the 9-fluorenone compound represented by Formula 1 is in a range of 0.1-20 parts by weight based on 100 parts by weight of a total weight of a solid content of the charge generating layer forming composition.

16. The electrophotographic cartridge of claim 13, wherein the overcoat layer includes at least one selected from the group consisting of polyaminoether, polyurethane and silsesquioxanes.

17. An electrophotographic drum, comprising:

a drum that is attachable to and detachable from an electrophotographic apparatus; and a positively-charged electrophotographic organic photoreceptor, disposed on the drum, the positively-charged electrophotographic organic photoreceptor comprising:

an electrically conductive support; and a charge transport layer and a charge generating layer sequentially stacked on the electrically conductive support, wherein the charge generating layer is formed by coating a charge generating layer forming composition comprising a 9-fluorenone compound represented by Formula 1, a charge generating material, a binder resin and an organic solvent on the charge transport layer, and drying:

Formula 1

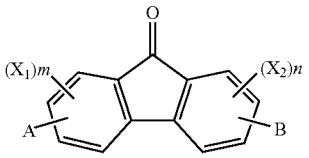

wherein A is selected from the group consisting of a carboxyl group, a substituted or unsubstituted $C_2$-$C_{10}$ alkoxycarbonyl group and a substituted or unsubstituted $C_2$-$C_{10}$ alkylaminocarbonyl group, B is a carboxyl group, $X_1$ and $X_2$ are independently a halogen atom, and m and n are independently an integer from 0 to 3.

18. The electrophotographic drum of claim 17, wherein the 9-fluorenone compound represented by Formula 1 includes a compound represented by Formula 2:

Formula 2

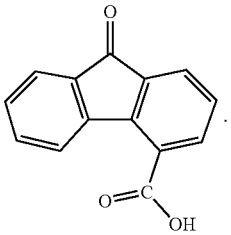

19. The electrophotographic drum of claim 17, wherein an amount of the 9-fluorenone_compound represented by Formula 1 is in a range of 0.1-20 parts by weight based on 100 parts by weight of a total weight of a solid content of the charge generating layer forming composition.

20. The electrophotographic drum of claim 17, wherein an overcoat layer is further formed on the charge generating layer.

21. The electrophotographic drum of claim 20, wherein the overcoat layer includes at least one selected from the group consisting of polyaminoether, polyurethane and silsesquioxanes.

22. An image forming apparatus comprising:

a photoreceptor unit comprising:

a positively-charged electrophotographic organic photoreceptor comprising:

an electrically conductive support; and a charge transport layer and a charge generating layer sequentially stacked on the electrically conductive support, wherein the charge generating layer is formed by coating a charge generating layer forming composition comprising a 9-fluorenone compound represented by Formula 1, a charge generating material, a binder resin and an organic solvent on the charge transport layer, and drying:

Formula 1

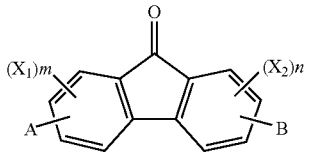

wherein A is selected from the group consisting of a carboxyl group, a substituted or unsubstituted $C_2$-$C_{10}$ alkoxycarbonyl group and a substituted or unsubstituted $C_2$-$C_{10}$ alkylaminocarbonyl group, B is a carboxyl group, $X_1$ and $X_2$ are independently a halogen atom, and m and n are independently an integer from 0 to 3;

a charging device which charges the photoreceptor unit;

an imagewise light irradiating device which irradiates the charged photoreceptor unit with imagewise light to form an electrostatic latent image on the photoreceptor unit;

a developing unit that develops the electrostatic latent image with a toner to form a toner image on the photoreceptor unit; and a transfer device which transfers the toner image onto a receiving material.

23. The image forming apparatus of claim 22, wherein the basic compound is at least one selected from the group consisting of ammonium hydroxide and sodium hydroxide, and an amount of the basic compound is in a range of 1 to 20 parts by weight based on 100 parts by weight of a total weight of solid content of the charge generating layer forming composition.

24. The image forming apparatus of claim 22, wherein an overcoat layer is further formed on the charge generating layer.

25. The image forming apparatus of claim 24, wherein the overcoat layer includes at least one selected from the group consisting of polyaminoether, polyurethane and silsesquioxanes.

26. An image forming apparatus comprising:

a photoreceptor unit comprising:

a positively-charged electrophotographic organic photoreceptor comprising:

an electrically conductive support; and a charge transport layer and a charge generating layer sequentially stacked on the electrically conductive support, wherein the charge generating layer is formed by coating a charge generating layer forming composition comprising a 9-fluorenone compound represented by Formula 1, a charge generating material, a binder resin and an organic solvent on the charge transport layer, and drying:

Formula 1

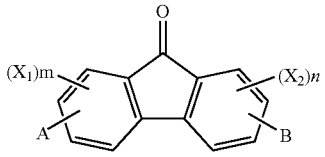

wherein A is selected from the group consisting of a carboxyl group, a substituted or unsubstituted $C_2$-$C_{10}$ alkoxycarbonyl group and a substituted or unsubstituted $C_2$-$C_{10}$ alkylaminocarbonyl group, B is a carboxyl group, $X_1$ and $X_2$ are independently a halogen atom, and m and n are independently an integer from 0 to 3;

a charging device which charges the photoreceptor unit;

an imagewise light irradiating device which irradiates the charged photoreceptor unit with imagewise light to form an electrostatic latent image on the photoreceptor unit;

a developing unit that develops the electrostatic latent image with a toner to form a toner image on the photoreceptor unit; and a transfer device which transfers the toner image onto a receiving material.

27. The image forming apparatus of claim 26, wherein the 9-fluorenone compound represented by Formula 1 includes a compound represented by Formula 2:

Formula 2

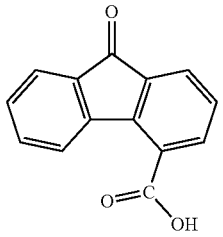

28. The image forming apparatus of claim 26, wherein an amount of the 9-fluorenone compound represented by Formula 1 is in a range of 0.1-20 parts by weight based on 100 parts by weight of a total weight of a solid content of the charge generating layer forming composition.

29. The image forming apparatus of claim 26, wherein the charge generating layer forming composition further comprises a basic compound.

30. The image forming apparatus of claim 29, wherein the basic compound is at least one selected from the group consisting of ammonium hydroxide and sodium hydroxide, and an amount of the basic compound is in a range of 1 to 20 parts by weight based on 100 parts by weight of a total weight of solid content of the charge generating layer forming composition.

31. The image forming apparatus of claim 26, wherein an overcoat layer is further formed on the charge generating layer.

32. The image forming apparatus of claim 31, wherein the overcoat layer includes at least one selected from the group consisting of polyaminoether, polyurethane and silsesquioxanes.

* * * * *

UNITED STATES PATENT AND TRADEMARK OFFICE

CERTIFICATE OF CORRECTION

PATENT NO. : 7,229,728 B2
APPLICATION NO. : 10/716452
DATED : June 12, 2007
INVENTOR(S) : Nam-Jeong Lee et al.

It is certified that error appears in the above-identified patent and that said Letters Patent is hereby corrected as shown below:

Title Page, item (75); Column 1 (Inventors), Line 2, change “Kyong-yol” to --Kyung-yol--.

Column 12, Line 64, after “ethanol” insert --,--.

Column 15, Line 15, change “fluorenone_compound” to --fluorenone compound--.

Signed and Sealed this

Sixth Day of November, 2007

JON W. DUDAS
*Director of the United States Patent and Trademark Office*